United States Patent [19]

Tiedemann

[11] 4,425,055

[45] Jan. 10, 1984

[54] TWO-SECTION ARCTIC DRILLING STRUCTURE

[75] Inventor: James B. Tiedemann, Fairbanks, Ak.

[73] Assignee: Shell Oil Company, Houston, Tex.

[21] Appl. No.: 345,261

[22] Filed: Feb. 2, 1982

[51] Int. Cl.[3] ..... E02B 17/00

[52] U.S. Cl. ..... 405/217; 405/204; 405/207

[58] Field of Search ..... 405/217, 207, 208, 195, 405/6 D, 205, 206, 224

[56] References Cited

U.S. PATENT DOCUMENTS

| | | | |
|---|---|---|---|
| 2,895,301 | 7/1959 | Casagrande et al. | 405/208 |
| 2,938,353 | 5/1960 | Vorenkamp | 405/207 |
| 3,021,680 | 2/1962 | Hayward | 405/207 |
| 3,412,564 | 11/1968 | McClintock | 405/208 |
| 3,962,878 | 6/1976 | Hansen | 405/195 |
| 4,040,263 | 8/1977 | Eide et al. | 405/195 |
| 4,245,929 | 1/1981 | Pearce et al. | 405/217 X |
| 4,314,776 | 2/1982 | Palmer et al. | 405/205 |

*Primary Examiner*—Dennis L. Taylor

[57] ABSTRACT

A lightweight drilling structure for use in offshore arctic waters comprising a lower frustoconical section and upper section wherein the lower section is towed to location, ballasted to sink in place on the sea floor and anchored in position by flooding the stability compartments. The upper section containing the drilling rig and equipment is then floated into place over the lower section, ballasted to rest on the lower section and the two sections sealed and fastened together. The assembled structure is firmly anchored in place by dewatering chambers located in the bottom of the lower section to create a suction between the bottom of the lower section and the ocean floor.

17 Claims, 1 Drawing Figure

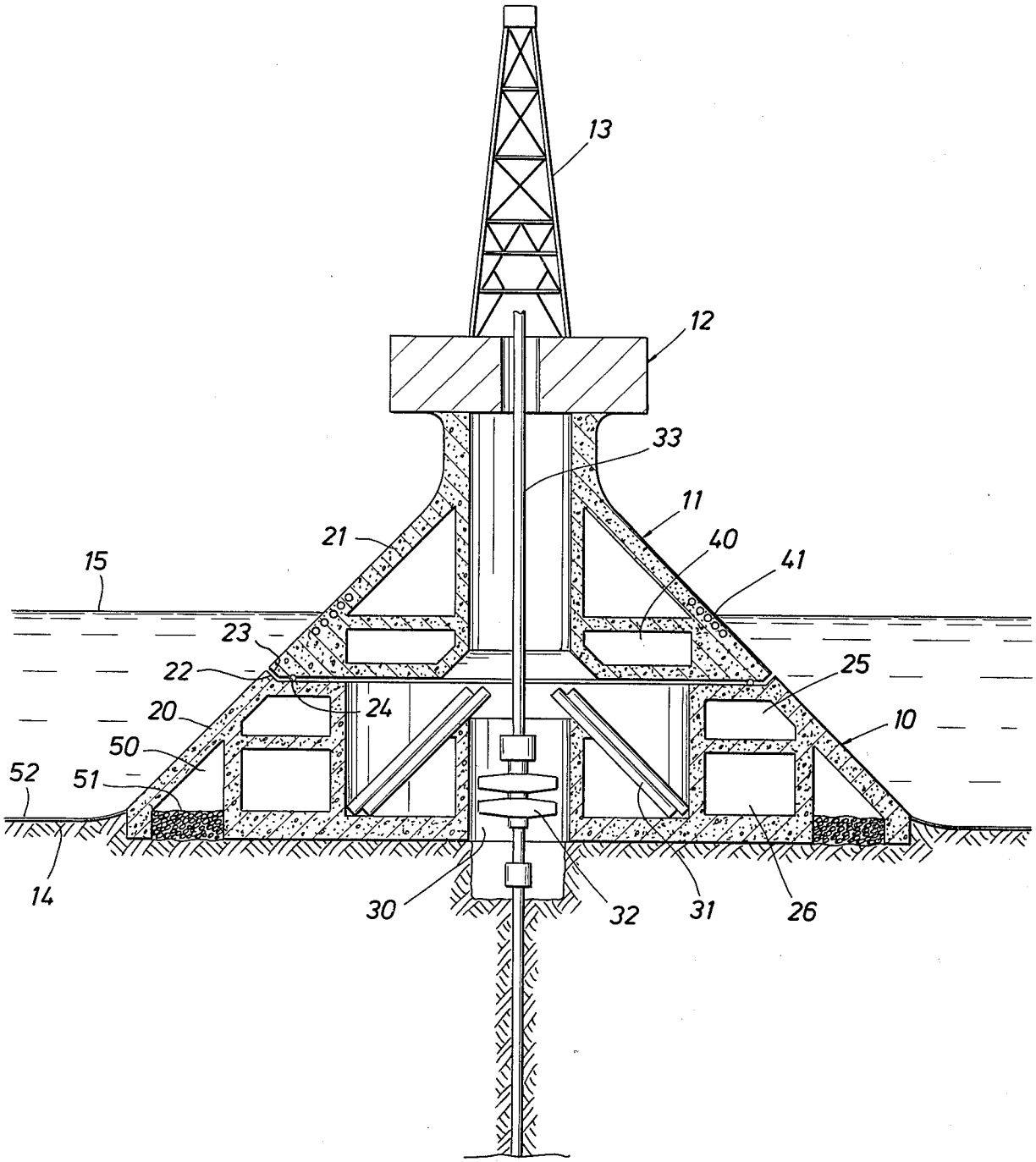
13
12
33
11
40
41
21
15
23
22
24
25
20
10
50
52
51
14
30
32
31
26

TWO-SECTION ARCTIC DRILLING STRUCTURE

BACKGROUND OF THE INVENTION

The present invention pertains to drilling structures and particularly to a drilling structure for use in Arctic waters, particularly the Beaufort Sea. As is well known, the Beaufort Sea is relatively shallow and subject to annual movement of sheet ice. Breaking up of the annual formation of ice in the Beaufort Sea occurs in June and July and depending upon the winds this broken ice will drift with the tides. The ice is strong in compression but relatively weak in tension. Thus, it is suggested that offshore structures used in the Beaufort Sea have sloping side walls which will cause the ice to ride up and fail in tension, breaking into smaller pieces which would not present a hazard to the structure.

Also, structures used in the Beaufort Sea must be firmly anchored in position so that they can resist the forces created by movement of the ice. In the past, it has been suggested that the platforms be relatively heavy and ballasted into position so that they would be firmly anchored on the bottom. Thus anchored, they were capable of resisting the moving ice and the tendency of the moving ice to tip the platform over. In this respect, it has been suggested that the platforms have a frustoconical shape so that they have a relatively large surface area at the bottom to resist the tipping action of the ice movement while still presenting an inclined surface to assist in breaking up the sheet ice. While this is a partial solution to the problem, it does result in relatively heavy platforms which are expensive to build and difficult to move. Further, due to the weight of the platform which increases its draft, its use is limited to rather deep waters.

In an attempt to assist in anchoring offshore arctic platforms, U.S. Pat. No. 4,037,424 suggests that reversible acting thrusters be positioned within chambers formed in the hull and communicating with the bottom of the floatable hull to draw soil from the subsoil into recesses in the hull and anchor the hull more firmly in place. The patent also suggests that the thrusters could be reversed when it is desired to release the hull from the ocean floor and move it to a new location. While this is a partial solution to the problem, the suggested hull is still a heavy structure and the main anchoring force is obtained from the weight of the hull.

A further problem occurs in offshore arctic structures when it is necessary to move the structure to prevent its damage from ice floes at certain times of the year. Under these conditions, it is necessary to remove the structure from the ocean floor and tow it to a safe location. This, of course, necessitates abandoning the well to possible damage from the ice floe. Since the possibility of damage to the well exists some means must be provided for protecting the wellhead structure which normally projects above the surface of the sea floor.

SUMMARY OF THE INVENTION

The present invention solves the above problems by providing a two-piece structure in which the bottom section has an overall height which is less than the depth of the water in which it will be installed. Thus, the bottom section of the platform can be installed and the upper section subsequently moved into position and married with the bottom section. This will permit removal of the upper section containing the drill works and personnel quarters and other equipment when the danger of large ice floes or ice movement occurrs. The bottom section will completely surround the wellhead and thus protect the wellhead from the ice floes.

In addition, the use of two structures permits each structure to be lighter than a single unitary structure would be. This decreases the draft of the structures and permits the structures to be installed in relatively shallow water. The structures are installed by first positioning the lower unit section over the desired site and then flooding the storage and ballast compartments to sink it into place. To ensure that stability is retained, the upper compartments are empty until it is in position. The suction compartments can then be evacuated to reduce the pore pressure and increase the shear strength of the sea floor to help anchor the lower section into position. The upper section can then be installed over the lower section and anchored or fastened in place. When it is necessary to move the upper section, the two sections can be disconnected and the upper section floated free and towed to a safe location.

BRIEF DESCRIPTION OF THE DRAWING

The present invention will be more easily understood from the following description when read in conjunction with the attached drawing showing a two-piece arctic structure constructed according to this invention installed on the ocean floor.

DESCRIPTION OF A PREFERRED EMBODIMENT

Referring to the drawing there is shown an arctic structure constructed according to this invention comprising a lower section 10, an upper section 11 that contains the living quarters for personnel, and operating equipment for the drilling rig 13. The upper and lower sections may be formed of metal using conventional ship construction or reinforced concrete. Further, the structures have a general frustocoinical shape to assist in both construction and the breaking of the sheet ice when it moves. When the water is deep enough so that the mud line is safe from ice contact it may be more economical to use a cylindrical shape for all or part of the lower section. As shown in the drawing, the upper surface of the lower section 10 is below the surface of the water 15 when it is positioned at the desired site. The two sections have generally sloping walls 20 and 21 which are part of the conical shape and are relatively thick to resist the momentum and force of the moving ice.

The upper surface 22 of the lower section has a similar configuration to the lower surface 23 of the upper section. As shown, the outer rim portion of the upper and lower sections have generally sloping surfaces which assists in locating the upper section on top of the lower section. A sealing ring 24 is positioned between the two surfaces to effect a water-tight seal between these surfaces. The sealing ring may be a solid deformable ring or an inflatable ring which can be inflated after the upper and lower structures are in position. After the structures have been positioned, they can be fastened together by suitable means such as bolts, for example explodable bolts, which could easily be exploded when it is desired to move the upper structures off the lower structure. The lower structure is provided with stability compartments 25 which are positioned above the ballast compartments 26. Normally, the ballast compartments will be deballasted when the lower section is moved between various locations.

The lower section is provided with a central opening 30 which forms a moon pool for mounting the wellhead structure 32. Surrounding the wellhead structure is an annular space in which pipe racks 31 can be located for storing drilling pipe and casing. Since the lower section will be flooded during installation at the drilling site, only materials which can be submerged in water can be positioned or stored in this area. The drill pipe 33 extends upward from the wellhead 32 through the upper section to the drill rig 13 positioned on top of the accommodation and machinery spaces 12.

Surrounding the outer periphery of the lower section is a plenum chamber 50 which can be evacuated to create a suction to hold the lower section in position. The plenum chamber may be subdivided into several chambers by radial or circumferential partitions. This would allow more control over the dewatering process since one or more could be disconnected if channeling should develop between the chamber and the outside edge of the skirt. This could produce voids in the sea floor and impair the integrity of the sea floor. It is also possible to pump grout into selected chambers to maintain the integrity of the sea floor. A filter, formed of sand, fabric, metal mesh or similar material or a combination of materials should be positioned in the open bottom of the plenum chamber to limit debris that is drawn through the pumps used in evacuating the plenum chamber. A flexible skirt 52 is attached to the outer periphery of the lower section and rests against the ocean floor 14. The skirt effectively seals the outer edge of the plenum chamber from the ocean floor and thus decreases the capacity of the pumps needed for evacuating the plenum chamber to create the suction hold-down. The evacuation of the plenum chamber in addition to providing a pressure differential between the sloping walls 20 and 21 and the bottom of the structure also increases the shear strength of the sea floor. The evacuation reduces the pore pressure and increases the shear strength. The volume of the sea floor so stabilized is increased by the use of the flexible skirt 52.

A typical structure according to the present invention could be utilized in 50-foot water depths and would have a base diameter of 200 feet and an overall weight of approximately 50,000 tons. In 50 feet of water, water pressure at the bottom or mud line would be approximately 22.2 psi and this could easily be reduced to 2 psi in the plenum chamber. This would increase the effective weight of the structure to 95,600 tons. The difference between the actual weight of the structure and its effective weight due to the suction hold down would obviously result in a considerable saving in overall weight and construction costs. Also, since the structure is lighter it can be installed in more shallow water and it could carry a greater load of machinery or supplies in the upper and lower sections when they are transported to a drilling site.

The complete structure is installed by first preparing the site by removing the surface sediment from a circular area several hundred feet in diameter. The lower unit is then positioned over the site and the storage and ballast compartments flooded to sink it into place. To ensure stability as the structure is being sunk into place, air is retained in the stability cells 25 until the lower unit is positioned at which time the stability compartments are flooded to press the lower unit firmly in place. The flexible skirt 52 is then installed and covered with a layer of gravel to anchor it in position. After the lower section is in position, the upper section is moved into position and ballasted into place above the lower section. The joint between the two sections is then rendered watertight by the sealing ring 24 and, if necessary, inflating the sealing ring. Similar means must be taken to ensure watertight seals between the various ducts which connect the plenum chamber 50 to the machinery in the platform 12, as well as the various stability and ballast chambers, and the pumping units in the platform. When the upper and lower sections are in position the pumps used for dewatering the various compartments may be started until the joint between the two sections is exposed at which time suitable fastening means may be installed. The water level can then be lowered further until the lower unit, partiularly the storage compartments containing the pipe racks 31 and the moon pool section 30, are dry. The wellhead surface casing can then be installed followed by the wellhead, and drilling operations commenced. Also, at this time the plenum chambers 50 can be evacuated to increase the suction hold down of the lower unit on the ocean floor.

During normal operations, in light ice conditions, the suction pumps can maintain a sufficient pressure differential between the plenum chamber 50 and the water pressure to maintain the lower unit firmly in place. This will also maintain the water level in the storage areas below the pipe storage area. If ice conditions worsen, it is possible to fill the ballast compartments 26 to add additional weight to the lower unit. When a point is reached which is beyond the design of the structure the upper unit may be detached, refloated and moved to a safe location. This will leave the lower section in position to protect the wellhead 32. The upper section can, of course, be prepared for detaching and then be detached by detonating the explosive bolts which are holding it to the lower section when the danger from ice is clear. When the upper section is detached, it will no longer be possible to maintain a pressure differential in the plenum chamber 50 and the suction hold down capability of the lower unit will be lost. The ballast sections of the lower unit should be sufficient to maintain it in position.

In normal moving operations, the same procedure will be followed but instead of detonating the explosive bolts, they will be removed and used the next time the platform is installed. Also, it will be necessary to dewater the ballast and stability sections of the lower unit in order for it to float free of the ocean floor. This may be accomplished by forcing air into the stability and ballast sections. If it is desired to utilize the lower section as part of a producing platform, it will be necessary to anchor it firmly in place by means of piles or similar devices.

An alternate arrangement to the drilling rig 13 described above would be to utilize the upper cone section 11 as a substitute for the drilling derrick 13. This would permit operation within a completely enclosed structure which would be desirable in the Beaufort Sea. Steps must be taken to protect the rotary table and that portion of the equipment which would be submerged when the upper unit is towed to a drill site. Also, steps would have to be taken to properly ventilate the upper section during drilling operations. The use of the upper section as a substitute for the drilling derrick would effectively lower the center of gravity of the upper section and thus increase its stability when moving the upper section from one site to another.

The drilling structure can be readily adapted to different drilling depths by utilizing different lower sections 10 and a standard upper section 11. In deeper waters, taller lower sections can be utilized to obtain sufficient height of the structure when installed. It is obvious that the lower unit must be installed in a sufficient depth of water so that it is possible to float the upper section over the top of it and lower it into position. Also, both the upper and lower sections could be tailored for particular water depths.

What is claimed is:

1. A lightweight structure for use in offshore arctic waters comprising:

a lower base section formed by a frustum of a cone, said lower section having at least one plenum chamber formed in the bottom of said lower base section and opened on the bottom, said plenum chamber being formed by the outer surface of the lower section and a vertical circular wall that joins the outer surface of the lower section at its upper end and the bottom surface of the lower section at its lower end;

an upper section, said upper section being adaptable to be placed on top of said lower base section and sealed thereto; and means for dewatering the plenum chamber formed in said lower base section after said lower and upper sections have been joined to provide a pressure differential between the outer surfaces of said lower base and upper sections and the bottom surface of said lower section.

2. The structure of claim 1 and in addition, a filter disposed in the open side of said plenum chamber.

3. The structure of claim 2 and in addition, a flexible skirt disposed to seal the lower section to the surface on which said lower section rests.

4. The structure of claim 1 wherein the overall height of said lower section is less than the water depth in which said lower section is installed.

5. The structure of claim 4 wherein the joint between said lower and upper sections is sealed with a sealing ring.

6. The structure of claim 5 wherein the sealing ring is a solid ring.

7. The structure of claim 5 wherein the sealing ring is an inflatable ring.

8. A lightweight offshore drilling structure for use in arctic waters comprising:

a lower base section having at least its upper portion formed from a frustum of a cone and containing both ballast and stability compartments in addition to a plenum chamber, said plenum chamber being in communication with the floor of the body of water in which the drilling structure is installed, said plenum chamber being formed by a circular vertical wall whose upper end is joined to the conical surface of the lower section and the lower end is joined to the bottom of the lower section to form a plenum chamber surrounding the periphery of the lower section;

an upper section adapted to be mated with and sealed to said lower section, said upper section containing the drilling rig; and means communiating with said plenum chamber to dewater said plenum chamber after said lower section is positioned on the floor of the body of water.

9. The drilling structure of claim 8 and in addition, means for dewatering said plenum chamber.

10. The drilling structure of claim 8 wherein the overall height of said lower section is less than the water depth.

11. The drilling structure of claim 10 where between the upper and lower sections is a solid sealing ring.

12. The drilling structure of claim 10 wherein the seal between the upper and lower sections is an inflatable sealing ring.

13. The drilling structure of claim 8 wherein said upper and lower sections are fastened together with exploding bolts.

14. The drilling structure of claim 10 wherein said upper section is a continuation of the conical shape of said lower section.

15. The drilling structure of claim 14 wherein the conical shape is continued until the total height of the conical shape exceeds the water depth.

16. The drilling structure of claim 8 wherein said plenum chamber is formed by a plurality of individual chambers positioned around the periphery of the lower section.

17. The drilling structure of claim 8 wherein said plenum chamber is subdivided into a plurality of individual chambers by partitions.

* * * * *